United States Patent [19]

Christophersen

[11] Patent Number: 4,512,222

[45] Date of Patent: Apr. 23, 1985

[54] LOOSENING TOOL FOR TIE ROD SLEEVES

[75] Inventor: Steven L. Christophersen, Clarkston, Mich.

[73] Assignee: Snap-on Tools Corporation, Kenosha, Wis.

[21] Appl. No.: 490,722

[22] Filed: May 2, 1983

[51] Int. Cl.[3] ..... B25B 19/00

[52] U.S. Cl. ..... 81/464; 29/276

[58] Field of Search ..... 81/464, 463; 29/254, 29/276, 275

[56] References Cited

U.S. PATENT DOCUMENTS

| | | | |
|---|---|---|---|
| 878,041 | 4/1908 | Butsch, Sr. | 29/276 |
| 1,362,911 | 12/1920 | Astin | 29/254 |
| 1,984,960 | 12/1934 | Beard | 254/104 |
| 2,497,498 | 2/1950 | Hamilton | 29/283 |
| 2,808,641 | 10/1957 | Sandell | 29/255 |
| 3,208,134 | 9/1965 | Krewson | 29/275 |
| 3,273,231 | 9/1966 | Andrews | 29/275 |
| 3,576,064 | 4/1971 | Brackin | 81/464 |
| 3,599,308 | 8/1971 | Fielder | 29/254 |
| 3,861,250 | 1/1975 | Zugai | 81/464 |
| 4,432,125 | 2/1984 | Monteleone et al. | 29/275 |

OTHER PUBLICATIONS

Snap-on Tools Corporation Catalog, p. 165.

*Primary Examiner*—James L. Jones, Jr.
*Attorney, Agent, or Firm*—Emrich & Dithmar

[57] ABSTRACT

The loosening tool includes a U-shaped body with a bore in one of the legs thereof. A shaft is slidably located in the bore and carries a hammer at one end and a reciprocating hammer engaging means at the other end. The hammer and the other leg have surfaces that generally match the surfaces of interconnected threaded members which are to be loosened.

3 Claims, 5 Drawing Figures

LOOSENING TOOL FOR TIE ROD SLEEVES

BACKGROUND OF THE INVENTION

In performing front-end alignment of a vehicle, the lengths of the tie rods must be adjusted to effect a change in toe-in of the front wheels. Each tie rod is defined by inner and outer tie rod elements which are threaded into an adjusting sleeve. By rotating the adjusting sleeve, the length of the tie rod can be adjusted and therefore the overall length of the tie rod selected.

Tie rods being underneath the vehicle are exposed to all of the elements and are therefore likely to be become corroded. Dirt, grime, salt, etc. tends to collect on these parts making it difficult to rotate the adjusting sleeve. Often a tool must be used to loosen the sleeve prior to adjusting.

In the past, the tool has simply been one including a head carried by a shaft. The mechanic would place the head, which commonly had a curved surface, against the sleeve. He struck the other end with a hammer, which tended to loosen the sleeve. The unidirectional force thus created tended to bend the sleeve and/or the tie rods, and actually make it more difficult to rotate.

SUMMARY OF THE INVENTION

It is therefore an important object of the present invention to provide a loosening tool for tie rod sleeves and the like which loosens the interconnection, while at the same time, not deforming the sleeve or the tie rod elements.

In summary, there is provided a loosening tool for loosening the interconnection between two threaded members, comprising a U-shaped body having a bight and spaced-apart upstanding first and second legs, the first leg including a bore therein the axis of which is generally parallel to said bight, the second leg having a leg surface generally mating with the surface of one of the threaded members, a shaft slidably disposed in the bore, a hammer on one end of the shaft located between the legs, the hammer having a hammer surface generally matching the surface of the one threaded member, the threaded members being insertable in the space between the hammer and leg surfaces, and means on the other end of the shaft for being engaged by a reciprocating hammer to cause the hammer and leg surfaces to repeatedly strike the threaded members so as to loosen the interconnection therebetween.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figures 1, 2, 3, 4, 5:
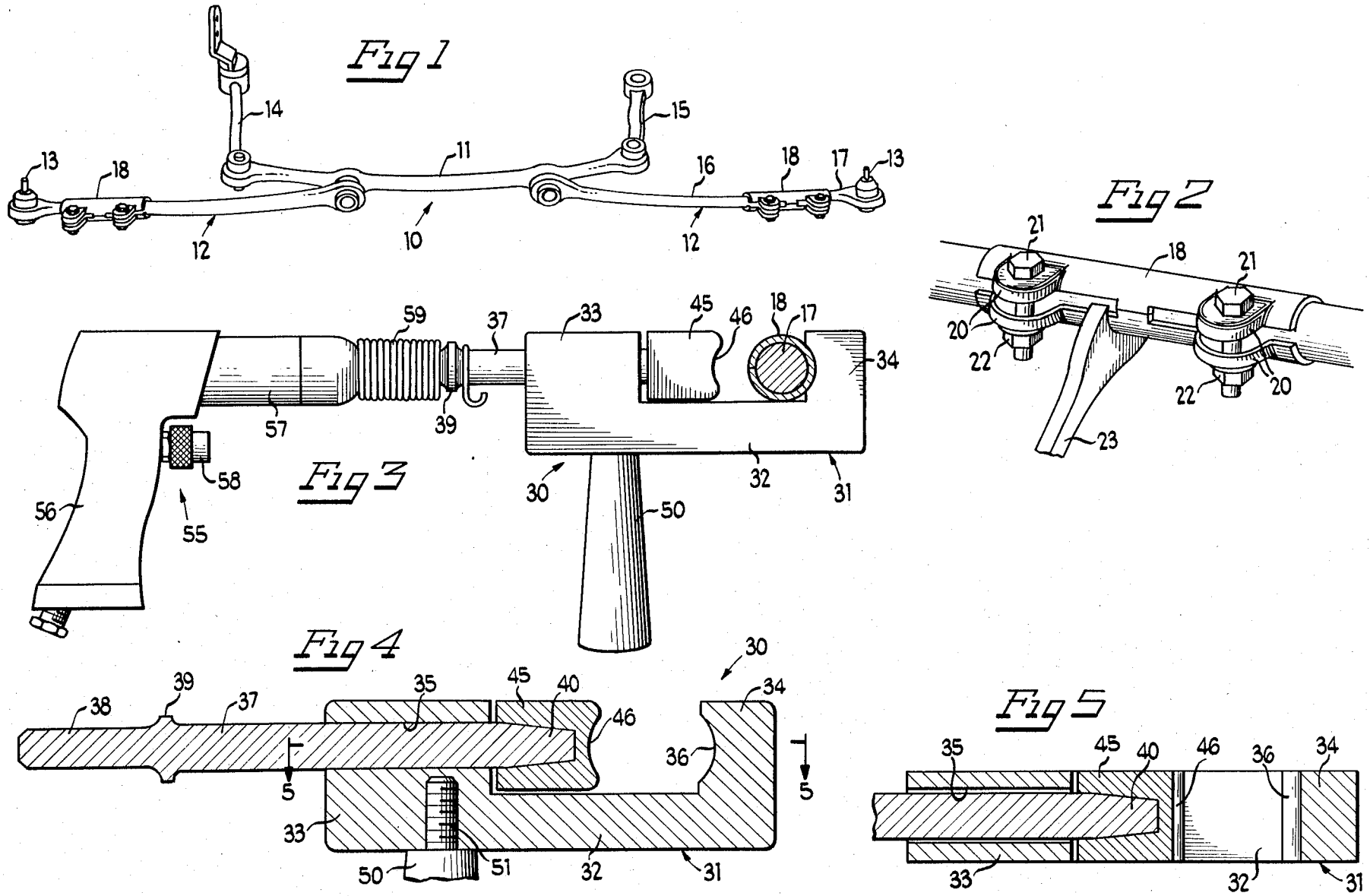
FIG. 1 is a perspective view of a steering linkage system incorporating tie rods and adjusting sleeves.
FIG. 2 is an enlarged perspective view of one adjusting sleeve and fragmentary portion of the tie rod elements extending therefrom.
FIG. 3 is an elevation view of a loosening tool incorporating the features of the present invention, together with an air hammer with which it is used.
FIG. 4 is an enlarged view in vertical section taken through the loosening tool of FIG. 3.
FIG. 5 is a fragmentary view in horizontal section taken along the line 5—5 of FIG. 4.

Turning now to the drawings and particularly to FIGS. 1 and 2 thereof, there is depicted a steering linkage system 10 including a center link 11 to which tie rods 12 are connected. The tie rods 12 connect the center link 11 with the steering arm of each front wheel by means of sockets 13. The steering linkage system 10 includes a Pitman arm 14 which connects the steering gear to the center link 11. The steering linkage system 10 also includes an idler arm 15 attached to the frame and to the other end of the center link 11 for supporting the curbside of the linkage and maintaining center link movement in a horizontal plane.

Each tie rod 12 consists of an inner tie rod element 16 and an outer tie rod element 17 which are threaded at one of their ends into an adjusting sleeve 18. The adjusting sleeve 18 is generally cylindrical, but is partially or fully slit along one side. The sleeve 18 includes two pairs of ears 19 and 20 through which pass bolts 21 secured by nuts 22. Instead of the ears, separate clamp straps could be provided.

When it is desired to adjust the toe-in in the process of aligning the front end of the vehicle, the length of each tie rod 12 must be adjusted. That is accomplished by loosening the nuts 22 and using a tool 23 to rotate the sleeve 18 in one direction to lengthen the tie rod 12 and in the other direction to shorten it. However, because the steering linkage system 10 is beneath the car, the threaded joints between the sleeve 18 and the tie rod elements 16 and 17 tends to become corroded and filled with dirt, grime, salt, etc. Thus, loosening the nuts 22 will not be enough to enable the sleeves 18 to be rotated. In the past, a tool with a concave head and a shaft has been employed. The head was placed against the sleeve 18 to be loosened and the free end of the shaft was struck with a hand or pneumatic hammer. Often this was unsuccessful because the sleeve 18 and/or the tie rod elements 13, 16 and 17 could become deformed.

Reference is made to FIGS. 3–5 which depict a loosening tool 30 incorporating the features of the present invention. The loosening tool 30 comprises a one-piece U-shaped body 31 having a relatively long bight 32 and relatively short legs 33 and 34. The leg 33 includes a bore 35 therein, the axis of which is generally parallel to the bight 32. The leg 33 therefore defines a bushing for the shaft 37. The inner surface 36 of the leg 34 is arcuate and, preferably part of a cylindrical surface. The tool 30 further comprises a shaft 37 slidably disposed in the bore 35. One end 38 of the shaft 37 defines an element which is to be struck by an air hammer as will be explained. The end 38 and the increased diameter collar 39 comprise a standard air hammer drive design. The other end 40 of the shaft 37 is somewhat tapered.

The tool 30 further comprises a hammer 45 which is generally block shaped. The hammer 45 has a surface 46 which is curved and preferably is part of a cylindrical surface to match the surface 36. The surfaces 36 and 46 are in facing relationship. The hammer 45 has a frustoconical bore therein with a shape generally matching the end 40 of the shaft 37. Preferably the size and the angle of the taper of the end 40 is slightly greater than the size and the angle of the taper of the bore in the hammer 45 in order to provide a secure press fit without the need of fasteners. In a specific embodiment, the taper on the shaft was 6° 15′, while the taper of the bore was 6° .

The tool 30 also comprises a handle 50 and a threaded stud 51 which is threaded into a bore in the leg 33, so that the handle depends in a direction normal to the bight 32.

Referring to FIG. 3, in use, the tool 30 is raised from beneath the steering linkage system 10 and positioned such that the sleeve 18 is located between the leg 34 and the hammer 45. The curvature of the surfaces 36 and 46 is preferably part of a cylindrical surface and generally matches the radius of curvature of the sleeve 18. Then the surfaces 36 and 46 will be on opposite sides of the sleeve 18. An air hammer 55 available in many forms in the marketplace has the usual handle 56, barrel 57, trigger 58 and tool-retaining spring 59. The spring 59 engages the collar 39. The mechanic holds the air hammer 55 in one hand and the handle 50 of the loosening tool 30 in the other hand. When the trigger 58 is depressed, the shaft 37 is caused to reciprocate which in turn causes the hammer 45 to repeatedly strike the sleeve 18. An opposite reaction is achieved according to the principles of physics so that the leg 34 which defines an anvil effectively strikes the opposite side of the sleeve 18. This procedure results in loosening of the sleeve 18 on the one hand, but because both sides of the sleeve 18 are struck, neither the sleeve 18 nor the tie rod elements 16 and 17 become deformed. Also, the loosening tool 30 does not fall off during use, as the mechanic is able to hold it upwardly such that the bottom of the sleeve 18 engages the bight 32.

What has been described, therefore, is an improved loosening tool specifically for tie rods.

I claim:

1. A loosening tool for loosening the interconnection between two threaded members, comprising a U-shaped body having a bight and spaced-apart upstanding first and second legs, said first leg including a bore therein the axis of which is generally parallel to said bight, said second leg having a leg surface generally mating with the surface of one of the threaded members, said leg surface being part of a cylinder, a shaft slidably disposed in said bore, a hammer on one end of said shaft located between said legs, said hammer having a hammer surface generally matching the surface of the one threaded member, said hammer surface being part of a cylinder, the threaded members being insertable in the space between said hammer and leg surfaces, means on the other end of said shaft for being engaged by a reciprocating air tool to cause the hammer and leg surfaces to repeatedly strike the threaded members so as to loosen the interconnection therebetween, said air tool engaging means being integral with said shaft, and an elongated handle permanently attached to said bight and being directed generally perpendicular to said shaft.

2. The loosening tool of claim 1, wherein said hammer is separate from but attached to said shaft.

3. The loosening tool of claim 1, wherein the one end of said shaft is tapered, said hammer having a tapered bore therein, the angles of and size of said one connection between said shaft and said handle.

* * * * *

UNITED STATES PATENT AND TRADEMARK OFFICE

CERTIFICATE OF CORRECTION

PATENT NO. : 4,512,222

DATED : April 23, 1985

INVENTOR(S) : Steven L. Christophersen

It is certified that error appears in the above-identified patent and that said Letters Patent is hereby corrected as shown below:

Claim 3, line 33, after "one" insert --end and said bore being such as to cause a press-fit--.

Signed and Sealed this

*Twenty-seventh* Day of *August 1985*

[SEAL]

*Attest:*

DONALD J. QUIGG

*Attesting Officer*

*Acting Commissioner of Patents and Trademarks*